United States Patent [19]

Nelson

[11] 3,998,163

[45] Dec. 21, 1976

[54] LUCKY-IN-BASE FUZE ASSEMBLY

[76] Inventor: James Gary Nelson, 427 Bernice Terrace, Aberdeen, Md. 21001

[22] Filed: Feb. 6, 1962

[21] Appl. No.: 171,537

[52] U.S. Cl. ..... 102/70.2 GA
[51] Int. Cl.[2] ..... F42C 11/02
[58] Field of Search ..... 102/70.2, 70.2 GA

[56] References Cited

UNITED STATES PATENTS

| | | | |
|---|---|---|---|
| 2,764,091 | 9/1956 | Hudson et al. | 102/70.2 GA |
| 2,972,306 | 2/1961 | Kabik et al. | 102/70.2 GA |

*Primary Examiner*—Charles T. Jordan
*Attorney, Agent, or Firm*—Nathan Edelberg; Robert P. Gibson

EXEMPLARY CLAIM

1. A fuze assembly for attachment to a projectile including a casing, a booster charge and a means for firing said booster charge in said casing; an acceleration energized electric energy source for said firing means comprising, an inertia mass slidably mounted in said casing, a first electrical terminal supported rearwardly in said casing, a piezoelectric element mounted between and in contact with said first terminal and said inertia mass, a second electrical terminal for contact with said firing means, said second terminal being secured forwardly in said casing; and a means for building up an electrical charge across said piezoelectric element comprising, a first resilient contact secured on said first terminal and being normally out of contact with said casing and a second resilient contact secured on said second terminal, said second resilient contact being in constant contact with said inertia mass, and being normally out of contact with said casing said inertia mass moving rearwardly upon projectile acceleration to energize said piezoelectric element and whereby said first and second resilient contacts upon maximum projectile acceleration contact said casing thereby shorting out said electrical charge built up across said piezoelectric element to said casing, said first and second resilient contacts resuming out-of-contact positions with respect to said casing upon reduced projectile acceleration.

4 Claims, 4 Drawing Figures

INVENTOR.
James G. Nelson

BY

S. I. Rotondi & A. J. Dupont

LUCKY-IN-BASE FUZE ASSEMBLY

The invention described herein may be manufactured and used by or for the Government for governmental purposes without the payment to me of any royalty thereon.

This invention relates to a Lucky-in-base fuze assembly and more particularly to the production of an electric voltage across a piezoelectric crystal by means of an inertial mass reacting to the acceleration and deceleration of a projectile associated with the firing of said projectile.

The present fuzing systems for high explosive anti-tank rounds, hereinafter referred to as heat, using a piezoelectric element, hereinafter referred to as "lucky," for producing an electric voltage for firing the round are not entirely satisfactory as the output of the voltage depends upon the angle of target impact of the nose of the projectile.

Since the penetration of heat projectiles is dependent on the stand-off distance, or distance between the shaped charge and the target, and since the projectile is traveling at approximately 4000 feet per second, a smaller than normal electrical impulse would cause a few micro-seconds delay in the functioning of the fuze and critically reduce armor penetration by decreasing the stand-off distance.

Upon 0° impacts a lucky could produce up to 10,000 volts, thus reducing the reliability of the fuze by breaking down the insulation.

Another problem area of heat projectile fuzes is that of sensitivity.

The usual technique of desensitizing a fuze of the HEAT type is to provide an air space in front of the lucky. This air space must be closed by the impact of the projectile before the voltage on the lucky can discharge causing detonation.

However, there are definite limits on the variation of sensitivity which can be accomplished by this technique. If the air space is too large, the shock wave occurring at impact will destroy the lucky before it can function the detonating mechanism; if the air space is too small, the fuze may still be over-sensitive.

It is therefore a primary object of this invention to provide a fuze assembly having a piezoelectric element that produces a highly regulative electrical pulse.

Another object of the invention is to provide a fuze assembly that will produce an electrical pulse independent of the point of impact when attacking a target at an oblique angle.

A further object is to provide a fuze assembly having a highly regulative sensitivity.

Other objects and advantages of the present invention will hereinafter become more fully apparant from the following description of the drawing which illustrates a preferred embodiment thereof and wherein.

Figure 1:
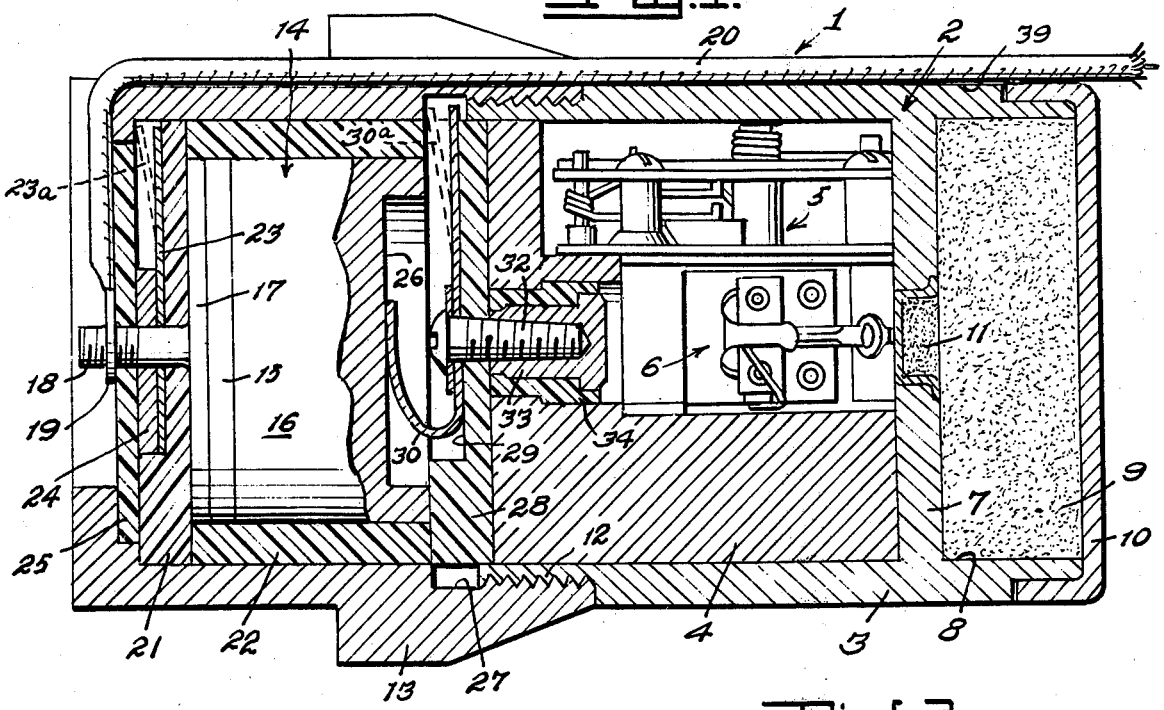
FIG. 1 is an axial section of the fuze assembly of the invention.
Figure 2:
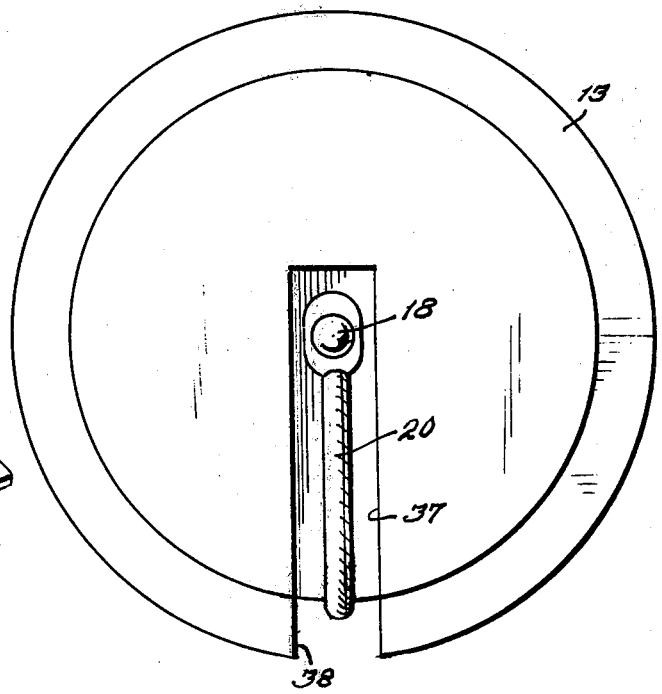
FIG. 2 is a rear view of the assembly.
Figure 3:
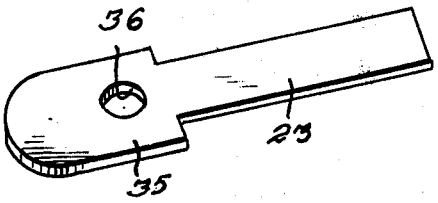
FIG. 3 is a perspective view of the rear contact spring.
Figure 4:
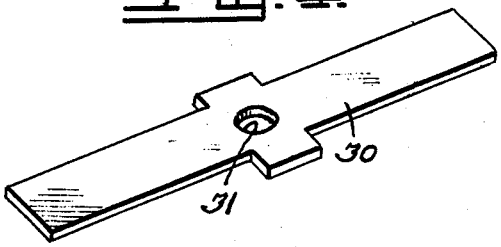
FIG. 4 is a perspective view of the front contact spring.

Referring to the drawing, character 1 indicates generally the fuze assembly of the invention in its entirety.

The assembly consists of two sections. The forward section, indicated generally by 2, as seen in FIG. 1, contains the usual firing and arming mechanisms of the fuze, including a tubular forward outer casing 3. A housing 4 contained in casing 3, contains the arming elements generally indicated by 5 and a firing switch indicated generally by 6.

Outer casing 3 is provided with a wall 7 to partition off a chamber 8 to contain a booster charge 9 which is enclosed by a cover 10.

A detonating charge 11 is disposed axially in wall 11 and is fired by switch 6 by means not shown.

Outer casing 3 is provided with a threaded rearward portion 12 which threadably secures it to a rearward tubular casing 13 which houses the lucky-in-base adaption, indicated generally by 14.

The lucky element is indicated by 15, and in this case is disc-like in shape.

Lucky element is in contact with a cylindrical inertia mass 16 at its forward side and a contact disc 17 is provided with an axially disposed, integral, rearwardly extending stud 18. Stud 18 is threaded to engage the terminal 19 of an electrical lead wire 20 connecting contact disc 17 electrically with a switch in the nose of the projectile, now shown.

Inertia mass 16 is axially slidable in casing 13.

Contact disc 17 is insulated from casing 13 by a spring insulating disc 21 while lucky element 15 and inertia mass 16 are insulated from casing 13 by an insulating sleeve 22.

A rearward contact spring 23 is provided and is secured against disc 21 by a base 24 and cover insulator 25.

Inertia mass 16 is recessed at its forward face as at 26.

An annular chamber 27 is formed in the forward portion of casing 13 and an insulator 28 is disposed in the aforesaid chamber in axial alignment with mass 16.

Insulator 28 is recessed as at 29 to provide space for a forward contact spring 30 which is provided with a medially located bore 31 for receiving a bushing screw 32 which rigidly secures spring 30 against insulator 28 and a contact bushing 33 which is held in an insulating grommet 34.

Contact bushing 33 is adapted to be contacted by firing switch 6 upon target impact of the projectile, not shown.

Front contact spring 30 is curled around at its rearward end to provide spring contact with inertia mass 16. The curled over portion of the spring extends into recess 26.

Rearward contact spring 23 is a flat strip of electrical conducting material and is provided with a wide head portion 35 and a bore 36 for stud 18 to pass through.

The rearward face of casing 13 is grooved radially as at 37 to provide a passage for lead 20 and the outer surface of casings 13 and 3 are grooved longitudinally as at 38 and 39 respectively for the same purpose.

The entire assembly 1 will be attached to a projectile, not shown, when in use.

OPERATION

When the projectile is fired, the extremely high acceleration forces the inertia mass 16 against lucky 15. These same acceleration forces, after reaching some predetermined level such as 20,000 G's, will pull front and rear contact springs 23 and 30 to positions 23*a* and 30*a* respectively, as seen in dotted lines in FIG. 1, until they are in electrical connection with each other through casing 13 and "short" or drain any voltage on lucky 15.

The acceleration of the projectile, after hitting a maximum of approximately 32,000 G's, will round off and begin to decrease. As these forces pass the 20,000 G mark on the downward portion of the acceleration curve, the contact springs will break contact and begin to return to their original positions. Then, as the inertia mass 16 returns to its static or normal position, a charge will be formed across lucky 15 and will remain until needed to activate the fuze.

The voltage thus produced across the lucky will remain until the nose switch of the projectile (not shown) is operated by impact with a target, thus closing the detonation circuit of the fuze (not shown) and causing the detonation of the shaped charge (not shown).

The voltage for detonation is thus produced by the ballistics of the projectile and the action of the contact springs 23 and 30. The magnitude of such a voltage can be accurately controlled by design and will be instantly available regardless of the impact angle with a target.

The sensitivity of the present device could be substantially reduced without involving the risk of having the lucky destroyed by shock. This is due primarily to the location of the lucky in the base of the projectile. If the projectile were striking a target, detonation would occur before the shock wave could travel the entire length of the projectile to the lucky 15.

Variations and modifications may be effected without departing from the scope of the novel concept of the present invention as set forth in the appended claims.

What is claimed is:

1. A fuze assembly for attachment to a projectile including a casing, a booster charge and a means for firing said booster charge in said casing; an acceleration energized electric energy source for said firing means comprising, an inertia mass slidably mounted in said casing, a first electrical terminal supported rearwardly in said casing, a piezoelectric element mounted between and in contact with said first terminal and said inertia mass, a second electrical terminal for contact with said firing means, said second terminal being secured forwardly in said casing; and a means for building up an electrical charge across said piezoelectric element comprising, a first resilient contact secured on said first terminal and being normally out of contact with said casing and a second resilient contact secured on said second terminal, said second resilient contact being in constant contact with said inertia mass, and being normally out of contact with said casing said inertia mass moving rearwardly upon projectile acceleration to energize said piezoelectric element and whereby said first and second resilient contacts upon maximum projectile acceleration contact said casing thereby shorting out said electrical charge built up across said piezoelectric element to said casing, said first and second resilient contacts resuming out-of-contact positions with respect to said casing upon reduced projectile acceleration.

2. A fuze assembly for attachment to a projectile including a tubular casing, a booster charge and electric means for detonating said booster in said casing; a means for supplying electric energy to said electric detonating means comprising, a first electrical terminal secured rearwardly and insulated from said casing, a cylindrical inertia mass slidably mounted in said casing, a piezoelectric disc disposed between and in electrical contact with said first electrical terminal and said inertia mass, said peizoelectric disc being insulated from said casing, a second electrical terminal forwardly of said inertia mass for contact with said electric detonating means upon projectile acceleration, said second electrical contact being insulated from said casing, a first spring contact connected to said first electrical terminal and being normally out of contact with said casing and a second spring contact fixed to said second electrical terminal and being in constant contact with said inertia mass, said first and second spring contacts contacting said casing upon a predetermined projectile acceleration whereby an electric charge built up in said piezoelectric element is shorted through said casing, said spring electrical contacts resuming out of contact positions with respect to said casing upon reduction of projectile acceleration.

3. A device as set forth in claim 2 wherein said first resilient contact comprises a flat strip of electric conducting material having a widened head portion said head portion being bored for securement of said strip to first electrical terminal.

4. A device as set forth in claim 2 wherein said second resilient contact comprises a flat strip of electric conducting material, said strip being centrally bored for securement of said strip to said second electrical terminal, one end of said strip being formed into a loop for constant contact with said inertia mass.

* * * * *